US008997591B1

(12) United States Patent
Vircks

(10) Patent No.: US 8,997,591 B1
(45) Date of Patent: Apr. 7, 2015

(54) CONTROL KNOB RETURN/DETENT MECHANISM

(71) Applicant: Bradley J. Vircks, Cedar Rapids, IA (US)

(72) Inventor: Bradley J. Vircks, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 13/973,301

(22) Filed: Aug. 22, 2013

(51) Int. Cl.
*G05G 1/10* (2006.01)

(52) U.S. Cl.
CPC ..... *G05G 1/10* (2013.01)

(58) Field of Classification Search
USPC ..... 74/10.22, 10.27, 10.29, 10.41, 10.45, 74/10 A, 10.6, 527, 553; 200/11 J, 16 C, 200/1 V, 11 R, 6 R, 565, 571, 11 A, 11 K, 18
See application file for complete search history.

(56) References Cited

U.S. PATENT DOCUMENTS 5,349,143 A * 9/1994 Houser ..... 200/11 J
5,436,413 A * 7/1995 Katakami ..... 200/14
8,332,079 B2 12/2012 Kindt et al.

OTHER PUBLICATIONS

Grayhill, Inc; Grayhill Optical Encoders; Brochure; Series 62HN High Torque, Non—Turn Concentric Shaft; pp. 14-15; Downloaded Aug. 16, 2013 From www.grayhill.com

* cited by examiner

*Primary Examiner* — Thomas Diaz
(74) *Attorney, Agent, or Firm* — Angel N. Gerdzhikov; Donna P. Suchy; Daniel M. Barbieri

(57) ABSTRACT

An encoder assembly including control knob return mechanisms and encoder elements. Each control knob return mechanism includes a frame assembly including return spring locators. A return rotor assembly, includes a rotor having a plurality of rotor located spring stops. A return mechanism rotatable shaft is operably positioned within the return rotor assembly and operably connectable to an encoder element. The rotor and the shaft are rotatably stationary relative to each other. A return spring is positioned about the rotatable shaft and operably positioned relative to the return spring locators and the rotor located spring stops to bias the return mechanism rotatable shaft and the rotor in a normally centered position. Each encoder element is connected to an associated return mechanism rotatable shaft of an associated control knob return mechanism, wherein the return mechanism rotatable shafts of the control knob return mechanisms are concentrically positioned relative to each other.

18 Claims, 4 Drawing Sheets

FIG. 1
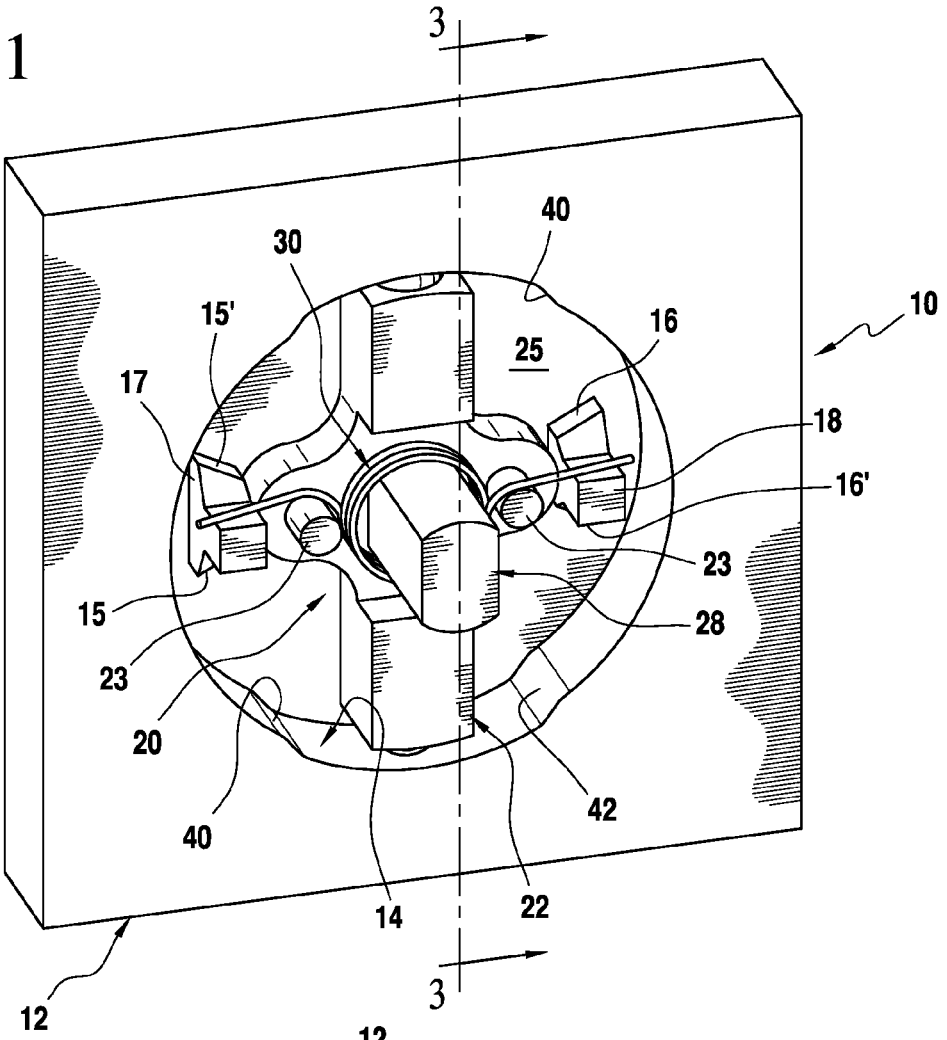
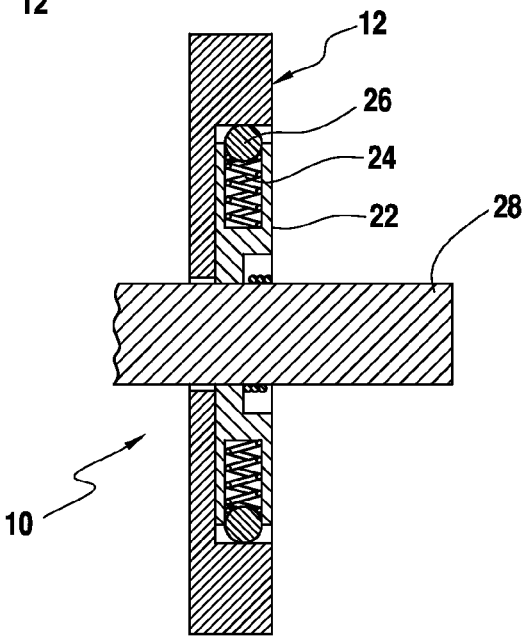
FIG. 3

CONTROL KNOB RETURN/DETENT MECHANISM

BACKGROUND OF THE INVENTION

1. Field of the Invention

The present invention relates generally to encoders, and more particularly to human interface optical encoders that provide tactile feedback to the user.

2. Description of the Related Art

Aircraft manufacturers desire to develop a very 'clean' look on their new designs for flight decks, in particular their control panel equipment. Size and weight minimization is extremely important relative to control panels. The encoders must meet comprehensive specifications, such as high reliability and usability, taking into account, among other things, the switch operating environment and human factors. The encoders implement control functions for essential equipment such as flight control, navigation and communication systems such as setting headings, altitudes, barometer, radio frequency, and notification limits.

Presently used encoder systems typically involve numerous gears, are space consuming, and are relatively heavy.

An optical encoder identified as SERIES 62HN is marketed by Grayhill, Inc., LaGrange, Ill. The SERIES 62HN encoder has a concentric shaft. It does not have a return to center feature.

SUMMARY OF THE INVENTION

In one aspect, the present invention is embodied as an encoder assembly including a plurality of control knob return mechanisms and a plurality of encoder elements. Each control knob return mechanism includes a frame assembly including a plurality of return spring locators. A return rotor assembly operably positioned relative to the frame assembly, includes a rotor having a plurality of rotor located spring stops. A return mechanism rotatable shaft is operably positioned within the return rotor assembly and operably connectable to an encoder element. The rotor and the return mechanism rotatable shaft are rotatably stationary relative to each other. A return spring is positioned about the return mechanism rotatable shaft and operably positioned relative to the plurality of return spring locators and the plurality of rotor located spring stops to bias the return mechanism rotatable shaft and the rotor in a normally centered position. Each encoder element is connected to an associated return mechanism rotatable shaft of an associated control knob return mechanism, wherein the return mechanism rotatable shafts of the plurality of control knob return mechanisms are concentrically positioned relative to each other.

In a preferred embodiment, each control knob return mechanism includes a detent surface formed therein and a plurality of end stops. In this embodiment, the return rotor assembly is embodied as a return/detent rotor assembly. The rotor includes a detent rotor. The return/detent rotor assembly includes a pair of opposing detent springs positioned within the detent rotor; and, a pair of detent balls. Each detent ball is biased toward the detent surface by a respective detent spring. The return mechanism rotatable shaft is embodied as a return/detent mechanism rotatable shaft. When the rotatable shaft is rotated to a first clockwise position the detent rotor rotation is impeded by first, ramped portions of the detent surface. When the rotatable shaft is rotated past the first ramped portions to a second clockwise position further clockwise rotation is prevented by at least one clockwise end stop. When the rotatable shaft is rotated to a first counterclockwise position the detent rotor rotation is impeded by second, ramped portions of the detent surface. When the rotatable shaft is rotated past the second, ramped portions to a second counterclockwise position further counterclockwise rotation is prevented by at least one counterclockwise end stop. In any of the clockwise or counterclockwise positions, when the rotatable shaft is released, it returns to the normally centered position.

Although useful for a number of applications, the encoder assembly of the present invention is particularly suitable for use in a control input assembly for an aircraft control panel. Since the encoders are driven off concentric shafts size and weight are minimized. Various control knob mechanisms and encoder elements can be contained within a single body. Additionally, the present invention eliminates the need for precision machined components.

BRIEF DESCRIPTION OF THE DRAWINGS

FIG. 1 is a front, perspective view of the control knob return/detent mechanism, in accordance with the principles of the present invention, in a center off position.

FIG. 3 is a view taken along line 3-3 of FIG. 1.

The same elements or parts throughout the figures of the drawings are designated by the same reference characters, while equivalent elements bear a prime designation.

DETAILED DESCRIPTION OF THE INVENTION

Figure 2:
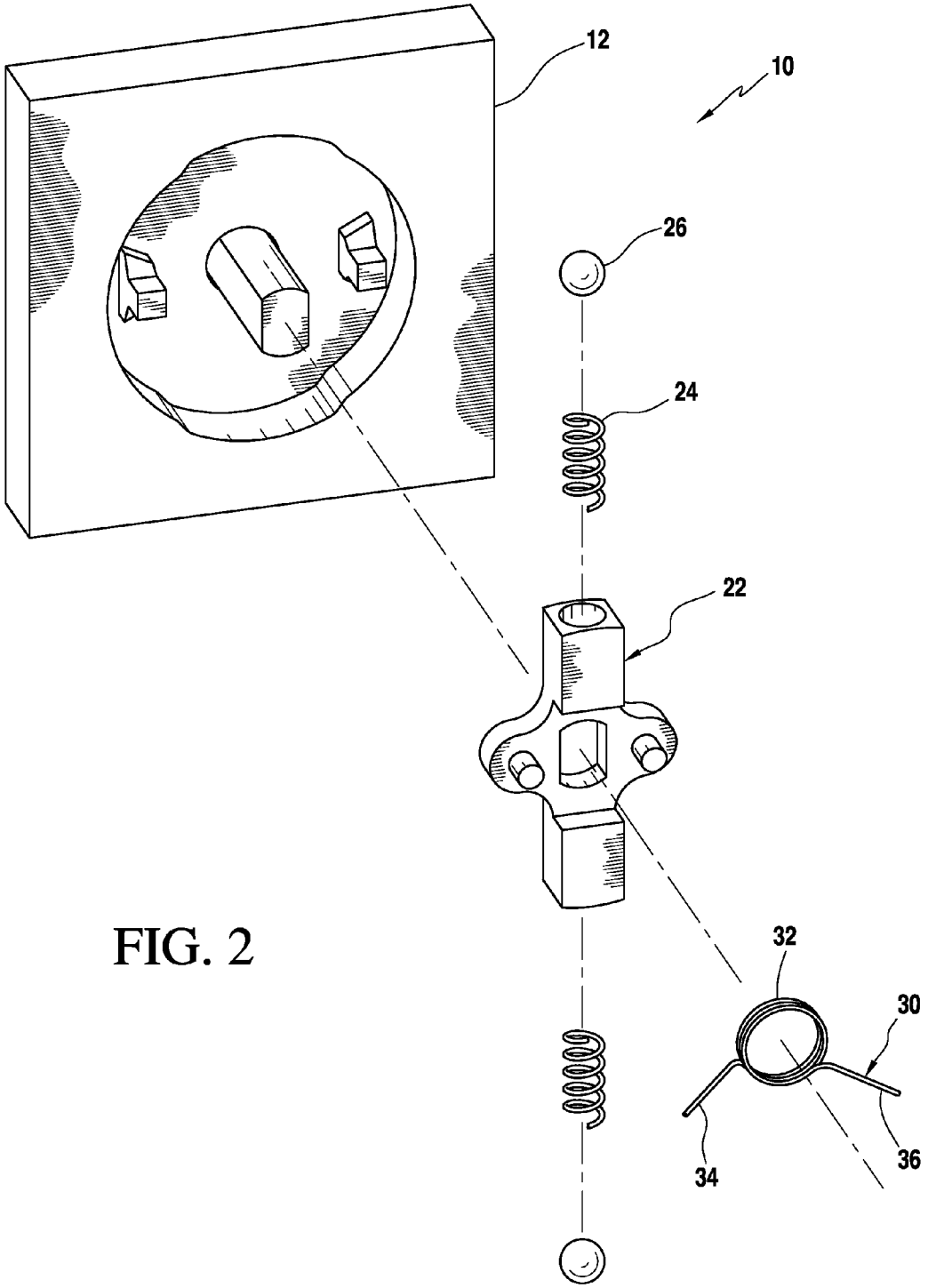
FIG. 2 is an exploded perspective view of the control knob return/detent mechanism of FIG. 1.

Referring now to the drawings and the characters of reference marked thereon, FIGS. 1-3 illustrate the control knob return/detent mechanism of the present invention, designated generally as 10. The control knob return/detent mechanism includes a frame assembly 12 including a detent surface 14 formed therein, a plurality of end stops 15, 15', 16, 16' and a plurality of return spring locators 17, 18. A return/detent rotor assembly, designated generally as 20, is operably positioned relative to the frame assembly. The return/detent rotor assembly 20 includes: i) a detent rotor 22 including a plurality of rotor located spring stops 23; ii) a pair of opposing detent springs 24 positioned within the detent rotor 22; and, iii) a pair of detent balls 26, each detent ball 26 being biased toward the detent surface 14 by a respective detent spring 24. In the embodiment illustrated the ends stops and return spring locator are constructed as an integrally formed unit providing both functions. However, they may be constructed as separate units. The two return spring locators are located on opposite sides of an opening 25 of the frame assembly 12 in which the rotor is located. The frame assembly is typically formed as a relatively thin rectilinear solid, as shown in FIG. 1. However, other shapes can be used as suitable for the particular application. Being relatively thin allows the control knob return/detent mechanism to be advantageously positioned adjacent to an associated encoder element and/or other control knob return/detent mechanisms, as will be explained below in detail. The frame assembly may be, for example, about 0.5 inches×0.5 inches×0.2 inches thick.

A return/detent mechanism rotatable shaft 28 is operably positioned within the return/detent rotor assembly 20 and operably connectable to an encoder assembly (not shown). The detent rotor 22 and the return/detent mechanism rotatable shaft 28 are rotatably stationary relative to each other (i.e. unable to rotate relative to each other).

A return spring 30 is positioned about the rotatable shaft 28 and operably positioned relative to the return spring locators 17,18 and the rotor located spring stops 23 to bias the return/detent mechanism rotatable shaft 28 and the detent rotor 22 in a normally centered position. The return spring 30 includes: a coiled element 32; and two ends 34, 36 extending from the coiled element 32, wherein the coiled element is coiled about the return/detent mechanism rotatable shaft 28 and each of the two ends 34, 36 abuts a respective of the return spring locators 16, 18. As can be seen in FIG. 2, in the free state, the ends 34, 36 of the return spring 30 are normally angled so that when installed it generates a pre-load force keeping the detent rotor 22 centered.

The present invention can be made of a variety of suitable materials. For example, if a relatively long service life is required, the present invention may be made of metallic components. If a light weight, relatively short service life, low cost assembly is required the parts can be made of, for example, injection molded plastic.

Figure 4:
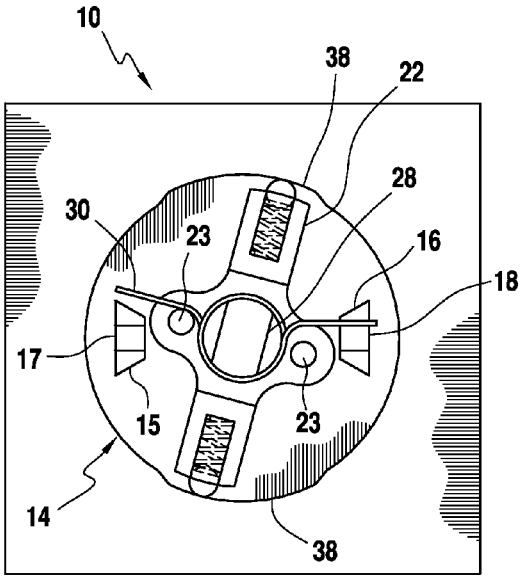
FIG. 4 illustrates the shaft and accompanying detent rotor rotated about 15 degrees clockwise from the center off position.

FIGS. 1-3 show the mechanism 10 at a center off position (0 degree rotation). Referring now to FIG. 4, the shaft 28 and accompanying detent rotor 22 are shown rotated about 15 degrees clockwise. The balls 26 are still in contact with recessed portions 38 of the detent surface 14. As the shaft 28 is turned the shaft 28 turns the rotor 22. As the rotor 22 turns the rotor located spring stop 23 on the left pushes against the left side of the return spring 30. Each spring stop is embodied as a post or extension perpendicular to the plane of rotation of the rotor. The right side of the return spring 30 bears against the return spring locator 18 on the right side. As the shaft 28 is rotated further and further clockwise the spring force increases. When the shaft 28 is released by the operator the return spring 30 bears against the left rotor located spring stop 23 which pushes the rotor 22 back to zero. The return spring 30 can be inserted either way, i.e. upside down, and the mechanism will still have the return to the normally centered position feature.

Figure 5:
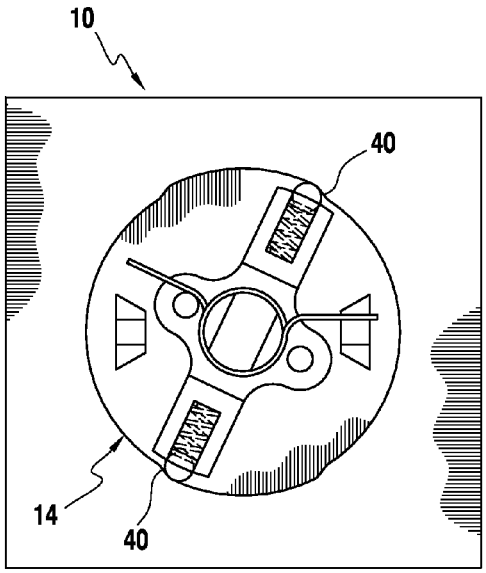
FIG. 5 illustrates rotation to a first clockwise position at first, ramped portions of the detent surface.

Referring now to FIG. 5, the shaft 28 and accompanying detent rotor 22 are shown rotated about 25 degrees clockwise. The detent rotor 22 rotation is impeded at a first clockwise position by first, ramped portions 40 of the detent surface 14.

Figure 6:
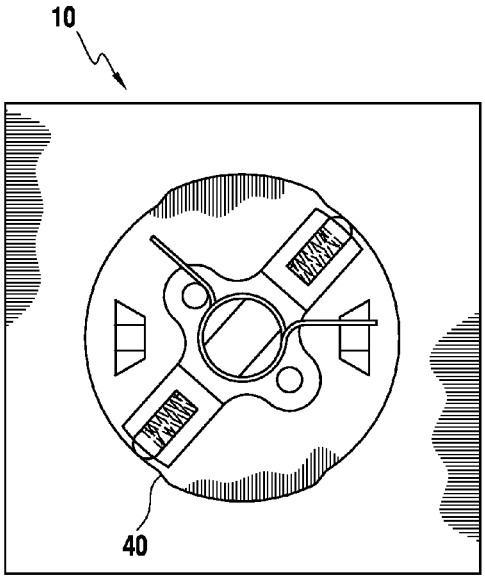
FIG. 6 illustrates further rotation past the first clockwise position.
Figure 7:
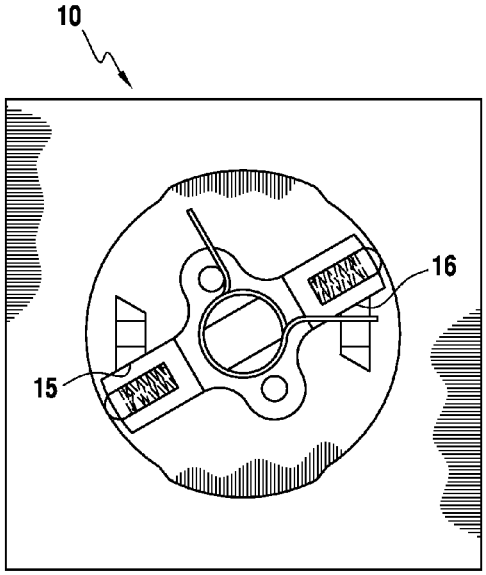
FIG. 7 illustrates further rotation to a second clockwise position, at stops where further rotation is prevented.

Referring now to FIG. 6, the shaft 28 and accompanying detent rotor 22 are shown rotated past the first, ramped portions 40. As shown in FIG. 7, when the shaft is rotated past the first ramped portions 40 to a second clockwise position further clockwise rotation is prevented by the clockwise end stops 15, 16.

Similarly, when the rotatable shaft is rotated to a first counterclockwise position the detent rotor rotation is impeded by second, ramped portions 42 of the detent surface. When the rotatable shaft is rotated past the second, ramped portions to a second counterclockwise position further counterclockwise rotation is prevented by the counterclockwise end stops 15', 16'.

In any of the clockwise or counterclockwise positions, when the rotatable shaft is released, it returns to the normally centered position.

The first clockwise position correlates with a first output signal of an associated encoder element. The second clockwise position correlates with a second output signal of the associated encoder element. The first counterclockwise position correlates with a third output signal of the associated encoder element. The second counterclockwise position correlates with a fourth output signal of the associated encoder element. The normally centered position correlates with a fifth output signal of the associated encoder element.

Figure 8:
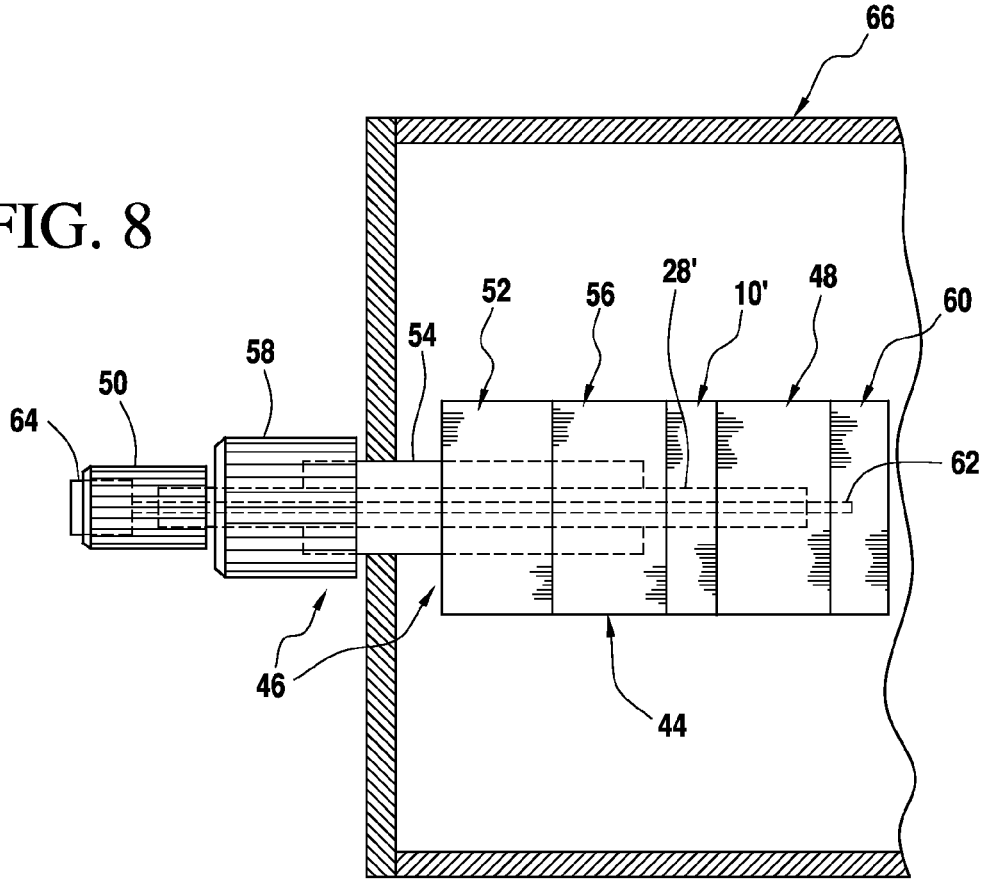
FIG. 8 shows the control knob return/detent mechanism utilized in a control input assembly.

The control knob return/detent mechanism 10 may be utilized for a variety of different purposes. For example, referring now to FIG. 8, its use in an encoder assembly 44 of a control input assembly 46 illustrated. The encoder assembly 44 includes a first control knob return/detent mechanism 10', as described above, with a first return/detent mechanism rotatable shaft 28'. A first encoder element 48 is operably associated with the first control knob return/detent mechanism 10'. The control input assembly 46 includes a first (i.e. outer) knob 50 connected to the first return/detent mechanism rotatable shaft 28'.

The encoder assembly 44 includes a second control knob mechanism 52 including a second control knob rotatable shaft 54. A second encoder element 56 is operably associated with the second control knob mechanism 52. The control input assembly 46 includes a second (i.e. inner) knob 58 connected to the second control knob mechanism rotatable shaft 28'. The first rotatable shaft and the second rotatable shaft are concentric. This obviates gears required in the prior art in which control mechanisms are side by side and must be driven independently. With the present invention the encoders are driven end to end and can be driven off of concentric shafts.

The encoder assembly 44 includes a third encoder element 60 connected to a third shaft 62. The control input assembly 46 includes a push button 64 connected to the third shaft 62. This is generally a non-turn push button. The components of the encoder assembly 44 are typically provided as modules that are bolted together.

The end stops 15, 15', 16, 16' preferably include ramped surfaces as shown in the figures. This feature prevents the spring from hanging up on the edge of stop. It also allows the return spring to be installed upside down. The design of the spring ends 36 as explained above with respect to FIG. 2 also aids in prevent snagging, malfunctions.

In alternative embodiments, the detent surfaces, detent springs and detent balls can be eliminated for an encoder with a simplified return to center operation. Thus, as in the previous embodiment each control knob return mechanism includes a frame assembly including a plurality of return spring locators. However, it doesn't have a detent surface. A return rotor assembly operably positioned relative to the frame assembly, includes a rotor having a plurality of rotor located spring stops. However, it may not include a detent spring or balls. A return mechanism rotatable shaft is operably positioned within the return rotor assembly and operably connectable to an encoder element. The rotor and the return mechanism rotatable shaft are rotatably stationary relative to each other. As in the previous embodiment a return spring is positioned about the return mechanism rotatable shaft and operably positioned relative to the plurality of return spring locators and the plurality of rotor located spring stops to bias the return mechanism rotatable shaft and the rotor in a normally centered position.

In other alternative embodiments, the detents could be depressions (or bumps) in the 'floor' of the frame and the detent springs/balls could be parallel to the shaft. Another way to provide detents is to have the rotor formed of a fully circular element with ramps on the outer perimeter of the rotor and have the detent balls/springs as part of the frame, pointed inwardly. Another embodiment is to form the rotor circular with detent ramps on a flat bottom face, detent springs/balls in the 'floor' of frame pointing upwards. In some of the alternative embodiments the balls/springs could be replaced by a simple leaf spring with a formed bump that serves as the 'ball'.

In other embodiments, there may be several detented positions in each direction before reaching end stop. In other embodiments there can be other combinations of detented positions, e.g. three detented positions to the clockwise direction and no detented positions counter clockwise.

Figure 9:
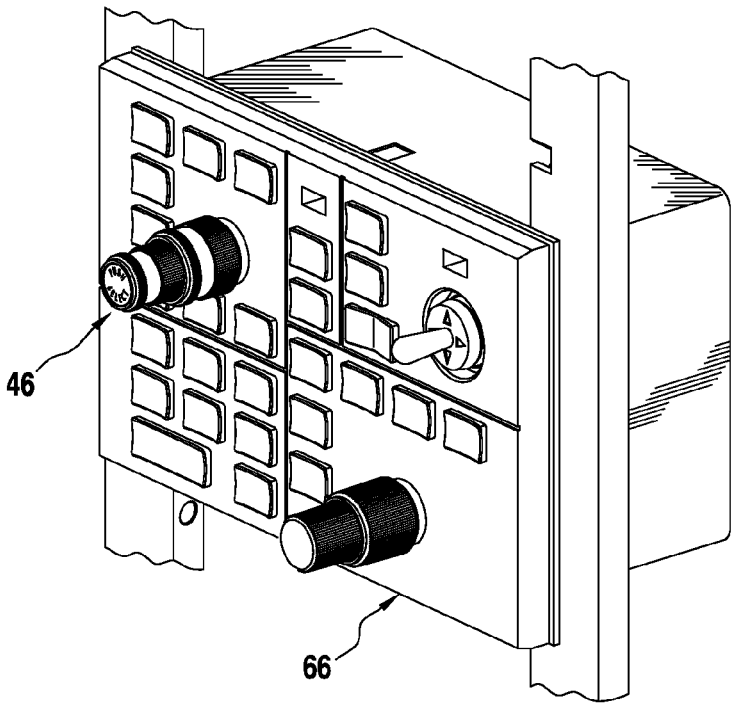
FIG. 9 shows the control input assembly utilized in a control panel.

The control input assembly 46 may typically be secured within some type of a control panel assembly 66. FIG. 9 illustrates how the control input assembly 46 may be utilized in an avionics control panel. Typically, the control knob return/detent mechanism provides positive tactile feedback. The first clockwise position typically indicates slow, positive. The second clockwise position typically indicates fast, positive. The first counter clockwise position typically indicates slow, negative. The second counter clockwise position typically indicates fast, negative.

In the Figures the term "knob" has been illustrated as raised from the surface of the control panel assembly 66. However, in other alternative embodiments the "knob" could be flush with the surface of the control panel or other housing surface used to secure the control knob return/detent mechanism. Thus, as used herein, the term the term "knob" is defined broadly to include such flush mounted actuators.

The present inventive concepts can be implemented with various types of encoders. For example, various encoders that can be bolted on to the control knob return/detent mechanism include optical encoders, electromechanical switch type encoders, and Hall effect encoders. Furthermore, the connection to processors may be compatible with, for example, CMOS, TTL and HCMOS Logic.

Other embodiments and configurations may be devised without departing from the spirit of the invention and the scope of the appended claims. For example, although the present invention has been described with respect to avionics applications it may be used in many applications, such as automotive, consumer appliance, and industrial controls.

What is claimed is:

1. A control knob return/detent mechanism, comprising:

a) a frame assembly including a detent surface formed therein, a plurality of end stops, and a plurality of return spring locators;

b) a return/detent rotor assembly operably positioned relative to said frame assembly, comprising: i) a detent rotor including a plurality of rotor located spring stops; ii) a pair of opposing detent springs positioned within said detent rotor; and, iii) a pair of detent balls, each detent ball being biased toward said detent surface by a respective detent spring;

c) a return/detent mechanism rotatable shaft operably positioned within said return/detent rotor assembly and operably connectable to an encoder element, said detent rotor and said return/detent mechanism rotatable shaft being rotatably stationary relative to each other;

d) a return spring positioned about said rotatable shaft and operably positioned relative to said plurality of return spring locators and said plurality of rotor located spring stops to bias said return/detent mechanism rotatable shaft and said detent rotor in a normally centered position, wherein i) when said rotatable shaft is rotated to a first clockwise position the detent rotor rotation is impeded by first, ramped portions of said detent surface, ii) when said rotatable shaft is rotated past said first ramped portions to a second clockwise position further clockwise rotation is prevented by at least one clockwise end stop, iii) when said rotatable shaft is rotated to a first counterclockwise position the detent rotor rotation is impeded by second, ramped portions of said detent surface, and iv) when said rotatable shaft is rotated past said second, ramped portions to a second counterclockwise position further counterclockwise rotation is prevented by at least one counterclockwise end stop; and, wherein in any of the clockwise or counterclockwise positions, when said rotatable shaft is released, it returns to said normally centered position.

2. The control knob return/detent mechanism of claim 1, wherein said first clockwise position correlates with a first output signal of an associated encoder element, said second clockwise position correlates with a second output signal of the associated encoder element, said first counterclockwise position correlates with a third output signal of the associated encoder element, said second counterclockwise position correlates with a fourth output signal of the associated encoder element, and said normally centered position correlates with a fifth output signal of the associated encoder element.

3. The control knob return/detent mechanism of claim 1, wherein said return spring comprises: a coiled element; and two ends extending from said coiled element, wherein said coiled element is coiled about said return/detent mechanism rotatable shaft and each of said two ends abuts a respective of said plurality of return spring locators in the normally centered position.

4. The control knob return/detent mechanism of claim 1, wherein said plurality of end stops comprise ramped surfaces.

5. The control knob return/detent mechanism of claim 1, wherein said control knob return/detent mechanism is used in an avionics control panel.

6. A control input assembly, comprising:

an encoder assembly, comprising:

A. a first control knob return/detent mechanism, comprising:

a) a frame assembly including a detent surface formed therein, a plurality of end stops, and a plurality of return spring locators;

b) a return/detent rotor assembly operably positioned relative to said frame assembly, comprising: i) a detent rotor; ii) a pair of opposing detent springs positioned within said detent rotor; and, iii) a pair of detent balls, each detent ball being biased toward said detent surface by a respective detent spring;

c) a first return/detent mechanism rotatable shaft operably positioned within said return/detent rotor assembly said detent rotor and said return/detent mechanism rotatable shaft being rotatably stationary relative to each other;

d) a return spring positioned about said rotatable shaft and operably positioned relative to said plurality of return spring locators to bias said return/detent mechanism rotatable shaft and said detent rotor in a normally centered position, wherein: i) when said rotatable shaft is rotated to a first clockwise position the detent rotor rotation is impeded by first, ramped portions of said detent surface, ii) when said rotatable shaft is rotated past said first ramped portions to a second clockwise position further clockwise rotation is prevented by at least one clockwise end stop, iii) when said rotatable shaft is rotated to a first counterclockwise position the detent rotor rotation is impeded by second, ramped portions of said detent surface, and iv) when said rotatable shaft is rotated past said second, ramped portions to a second counterclockwise position further counterclockwise rotation is prevented by at least one counterclockwise end stop, and, wherein in any of the clockwise or counterclockwise positions, when said rotatable shaft is released, it returns to said normally centered position, B. a first encoder element associated with said first control knob return/detent mechanism;

C. a second control knob mechanism including a second control knob mechanism rotatable shaft;

D. a second encoder element associated with said second control knob mechanism; and, E. a third encoder element connected to a third shaft.

7. The control input assembly of claim 6, further comprising:

a) a first knob connected to said first return/detent mechanism rotatable shaft;

b) a second knob connected to said second control knob mechanism rotatable shaft; and, c) a push button connected to said third shaft.

8. The control input assembly of claim 7, wherein, a) said first knob comprises an outer knob; and, b) said second knob comprises an inner knob.

9. The control input assembly of claim 6, wherein said control input assembly is used in an avionics control panel.

10. An encoder assembly, comprising:

a plurality of control knob return mechanisms, each comprising:

a) a frame assembly including a plurality of return spring locators;

b) a return rotor assembly operably positioned relative to said frame assembly, comprising a rotor including a plurality of rotor located spring stops;

c) a return mechanism rotatable shaft operably positioned within said return rotor assembly and operably connectable to an encoder element, said rotor and said return mechanism rotatable shaft being rotatably stationary relative to each other;

d) a return spring positioned about said return mechanism rotatable shaft and operably positioned relative to said plurality of return spring locators and said plurality of rotor located spring stops to bias said return mechanism rotatable shaft and said rotor in a normally centered position; and, a plurality of encoder elements, each being connected to an associated return mechanism rotatable shaft of an associated control knob return mechanism, wherein the return mechanism rotatable shafts of said plurality of control knob return mechanisms are concentrically positioned relative to each other.

11. The encoder assembly of claim 10, wherein said plurality of rotor located spring stops comprises two rotor located spring stops located on opposite sides of the rotor.

12. The encoder assembly of claim 10, wherein said plurality of rotor located spring stops comprises two rotor located spring stops located on opposite sides of the rotor, each spring stop comprising a perpendicular extension from a plane of rotation of the rotor.

13. The encoder assembly of claim 10, wherein said plurality of return spring locators comprises two return spring locators located on opposite sides of an opening of the frame assembly in which the rotor is located.

14. The encoder assembly of claim 10, wherein each of said plurality of control knob return mechanisms, comprises:

a) said frame assembly further including a detent surface formed therein and a plurality of end stops;

b) said return rotor assembly comprises a return/detent rotor assembly, said rotor comprising a detent rotor; wherein said return/detent rotor assembly further comprises:

a pair of opposing detent springs positioned within said detent rotor; and, a pair of detent balls, each detent ball being biased toward said detent surface by a respective detent spring;

c) said return mechanism rotatable shaft comprises a return/detent mechanism rotatable shaft;

wherein i) when said rotatable shaft is rotated to a first clockwise position the detent rotor rotation is impeded by first, ramped portions of said detent surface, ii) when said rotatable shaft is rotated past said first ramped portions to a second clockwise position further clockwise rotation is prevented by at least one clockwise end stop, iii) when said rotatable shaft is rotated to a first counterclockwise position the detent rotor rotation is impeded by second, ramped portions of said detent surface, and iv) when said rotatable shaft is rotated past said second, ramped portions to a second counterclockwise position further counterclockwise rotation is prevented by at least one counterclockwise end stop, and, wherein in any of the clockwise or counterclockwise positions, when said rotatable shaft is released, it returns to said normally centered position.

15. The encoder assembly of claim 14, wherein said plurality of end stops comprise ramped surfaces.

16. The encoder assembly of claim 14, wherein said plurality of rotor located spring stops comprises two rotor located spring stops located on opposite sides of the rotor.

17. The encoder assembly of claim 14, wherein said plurality of rotor located spring stops comprises two rotor located spring stops located on opposite sides of the rotor, each spring stop comprising a perpendicular extension from a plane of rotation of the rotor.

18. The encoder assembly of claim 14, wherein said plurality of return spring locators comprises two return spring locators located on opposite sides of an opening of the frame assembly in which the rotor is located.

* * * * *